United States Patent [19]

Anderson

[11] Patent Number: 4,990,215

[45] Date of Patent: Feb. 5, 1991

[54] WEB-ALIGNING APPARATUS

[75] Inventor: Conrad V. Anderson, Minneapolis, Minn.

[73] Assignee: Minnesota Mining and Manufacturing Company, St. Paul, Minn.

[21] Appl. No.: 279,192

[22] Filed: Dec. 2, 1988

[51] Int. Cl.[5] ..... B32B 31/04

[52] U.S. Cl. ..... 156/540; 156/543; 242/57.1; 242/68.7; 242/76; 226/15; 226/17; 226/19

[58] Field of Search ..... 156/540, 543, 494; 226/15, 17, 19, 24, 34, 38, 39, 182, 187; 242/57.1, 68.7, 76, 140, 128, 157 R

[56] References Cited

U.S. PATENT DOCUMENTS

| | | | |
|---|---|---|---|
| 855,482 | 6/1907 | Savage | 226/17 |
| 1,213,771 | 1/1917 | Leen et al. | 242/76 |
| 1,697,958 | 1/1929 | Manker | 242/57.1 |
| 1,921,405 | 8/1933 | Cullen | 242/76 |
| 2,827,809 | 3/1958 | Beam | 226/19 |
| 3,039,710 | 6/1962 | Walter | 242/76 |
| 3,087,665 | 4/1963 | Thomas | 226/19 |
| 3,177,751 | 4/1965 | Vercauteren | 226/19 |
| 3,244,340 | 4/1966 | Fife et al. | 226/22 |
| 3,317,101 | 5/1967 | Himrod et al. | 242/57.1 |
| 3,598,332 | 8/1971 | Sharkey | 242/71.8 |
| 3,784,076 | 1/1974 | Avery et al. | 226/179 |
| 3,885,899 | 5/1975 | Gurta et al. | 226/19 |
| 4,068,789 | 1/1978 | Young, Jr. et al. | 226/3 |
| 4,153,218 | 5/1979 | Martin | 242/75.3 |
| 4,322,044 | 3/1982 | Bilek | 242/75.4 |
| 4,421,228 | 12/1983 | Marsighio et al. | 198/814 |
| 4,500,045 | 2/1985 | Whitaker et al. | 242/57.1 |
| 4,527,069 | 7/1985 | Pfizenmaier | 250/548 |
| 4,572,417 | 2/1986 | Joseph et al. | 226/20 |
| 4,575,065 | 3/1986 | Jung et al. | 270/31 |

FOREIGN PATENT DOCUMENTS

| | | |
|---|---|---|
| 2328647 | 5/1977 | France . |
| 605367 | 9/1978 | Switzerland . |

*Primary Examiner*—Caleb Weston

*Attorney, Agent, or Firm*—Donald M. Sell; Walter N. Kirn; Stephen W. Bauer

[57] ABSTRACT

Apparatus for aligning an elongate web with respect to a predetermined path of travel. The web is supplied from a supply roll formed by the web being wound around an inner web layer and having an outer web layer. The apparatus includes a frame, and an axle assembly on the frame adapted to hold the supply roll for rotation about an axis to afford unwinding of the web from the supply roll, and adapted for axial movement of the supply roll. An alignment device is provided comprising web-guiding rollers mounted on the frame and generally rigid in the direction parallel to the axis of the rotatable-holding means. The web-guiding rollers guide the opposite edges of the outer web layer of the web laterally with respect to the longitudinal direction of the web, with the axle assembly affording translation of the supply roll to accommodate telescoped or non-uniformly wound supply rolls, thereby to maintain alignment of the outer web layer with respect to the predetermined path of travel.

30 Claims, 3 Drawing Sheets

WEB-ALIGNING APPARATUS

The invention relates generally to web-aligning apparatus, and more particularly to apparatus for aligning a web with respect to a predetermined path.

BACKGROUND OF THE INVENTION

When processing webs, it is frequently necessary to align the webs being processed with respect to some predetermined path of travel. For example, it is usually desirable to maintain the edges of webs being laminated in alignment with one another, without reducing the typically high speeds of the web-laminating process. Improper alignment may lead to excessive waste of material, and low quality and possibly useless laminated web.

Possible causes of improper alignment include, among other things, flexing of the web-laminating apparatus in operation, wandering of the web laterally with respect to its principal direction of motion along the rollers of the apparatus, and telescoping of the web on its web-supply roll, that is, the layers of the web in the roll being laterally or axially offset with respect to one another. Flexing of the apparatus has been reduced by over-designing the machinery to reduce or eliminate the flexing, although this increases the cost and weight of the machinery, and by supporting both ends of the rollers, although this makes loading the web-supply roll more difficult.

U.S. Pat. No. 3,598,332 discloses, among other things, a web-supporting roller assembly including two circular flanges adjacent opposite ends of the roller, against which a loosely wound web on the roller can be tapped to align the edges of the wound web, thereby reducing or eliminating telescoping of the web on the roller. The flanges are centered on the axis of rotation of the roller, and rotate with the roller. It is believed that the assembly is unsuitable for aligning the edges of tightly wound web, the layers of which would resist being forced into edge alignment on the roller. U.S. Pat. No. 4,322,044 discloses paper alignment and loading apparatus utilizing a leaf spring mounted at one end of a drive roll and bearing against an edge of the wound paper to, among other things, laterally position the paper.

Web alignment has also been attempted by electronic tracking of the webs and shifting the webs in response to an electronic signal generated according to the position of the web. Electronically-controlled apparatus of various types are discussed in U.S. Pat. Nos. 3,244,340; 4,068,789; 4,500,045; 4,527,069; 4,572,417; and 4,575,065. U.S. Pat. No. 3,784,076 discloses, among other things, a web guide roll having slats along its outer surface that translate in response to a signal to guide the web. Problems with such apparatus include the complexity and expense of the apparatus, and dependence on possibly unreliable electronic feedback to maintain the alignment of the webs.

SUMMARY OF THE INVENTION

The invention provides apparatus useful for aligning an elongate web with respect to a predetermined path of travel, even when the web is supplied on a telescoped or non-uniformly-wound roll; that is especially useful for aligning a first web with respect to a second web moving along a generally constant, predetermined path and for rapidly laminating the two elongate webs; that is designed to align the first web with respect to the second web to maintain the edges of the webs in a predetermined relationship, e.g., aligned, even when the first web is supplied on a telescoped supply roll; that is adapted for easy loading and unloading of the first web; and that is uncomplicated in design and reliable in use.

Generally, the apparatus is adapted for aligning an elongate web having opposite edges extending longitudinally of the web. The web is supplied from a supply roll formed by the web being wound around an inner web layer and having an outer web layer. The apparatus comprises a frame, and rotatable-holding means on the frame adapted to hold the supply roll for rotation about an axis to afford unwinding of the web from the supply roll. The rotatable-holding means also affords axial movement of the supply roll. An alignment device is provided comprising web-guiding means mounted on the frame and generally rigid in the direction parallel to the axis of the rotatable-holding means. The web-guiding means is adapted for guiding the opposite edges of the outer web layer of the supply roll laterally with respect to the longitudinal direction of the web, with the rotatable-holding means affording translation of the supply roll to accommodate telescoped or non-uniformly wound supply rolls, thereby to maintain alignment of the outer web layer with respect to the predetermined path of travel.

Other features will be in part apparent and in part pointed out hereinafter.

BRIEF DESCRIPTION OF THE DRAWINGS

The present invention will be further described with reference to the drawing wherein corresponding reference characters indicate corresponding parts throughout the several views of the drawing, and wherein.

DETAILED DESCRIPTION OF THE INVENTION

Figure 1:
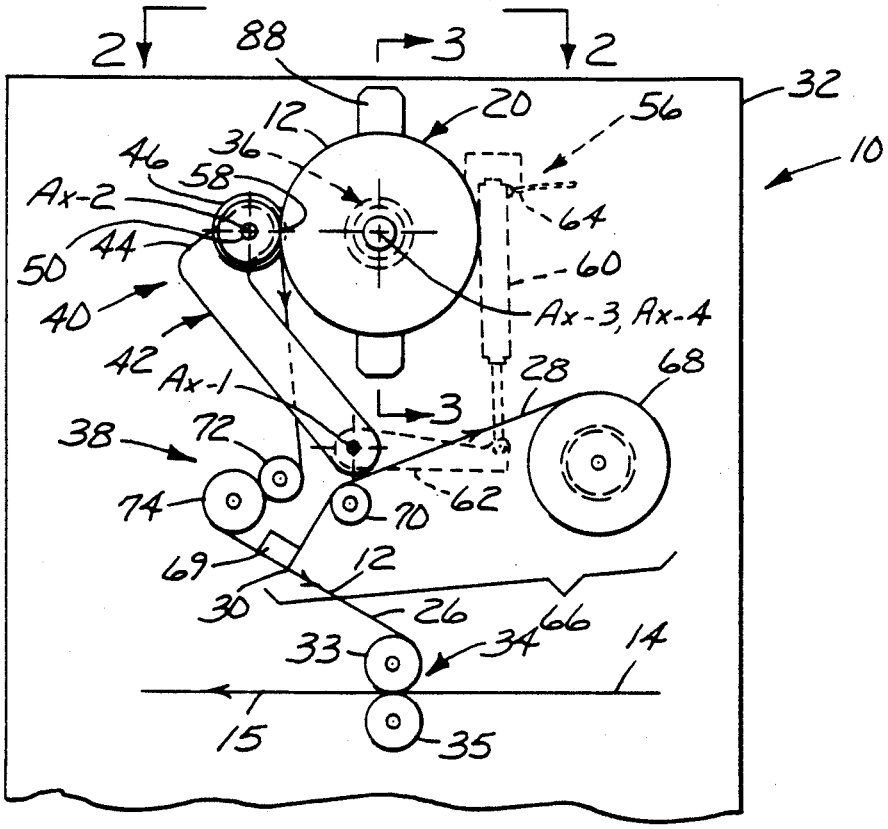
FIG. 1 is a schematic view of apparatus of the invention.

Now referring to FIG. 1, apparatus of the invention is designated in its entirety by the reference numeral 10. The apparatus 10 is useful for aligning a first elongate web 12 with respect to a predetermined path of travel, and for laminating the first web 12 to a second elongate web 14. The first web 12 is elongate in a first-web-longitudinal direction, and the second web 14 is elongate in a second-web-longitudinal direction (horizontally leftwardly in FIG. 1). The second web 14 moves along a predetermined, generally constant horizontal path in the second-web-longitudinal direction (from right to left in FIG. 1). The first web 12 has opposite edges 16 and 18 extending longitudinally of the web, and is supplied from a first-web-supply roll 20 formed by the web being wound around an inner web layer 22 to an outer web layer 24. The first web 12 is preferably of the type having a layer 26 of pressure sensitive adhesive and a backing web or liner 28 covering the adhesive. The backing web 28 is adapted to be stripped away (at 30) from the first web 12 to expose the adhesive layer 26. Other types of adhesives, such as hot melt adhesives or adhesives that are applied to the web immediately before laminating, are also contemplated.

The apparatus 10 is especially designed to be used as part of a process of fabricating automobile license plates from reflective sheeting (the first web), such as the reflective sheeting of the type sold under the trade designation "Reflecto-Lite" by the Minnesota Mining and Manufacturing Co. of St. Paul, Minnesota, and metal backing materials (the second web), such as aluminum or galvanized steel. The apparatus 10 is adapted to supply the laminated web 15 to other machines for further processing, such as cutting, stamping or sealing. The apparatus 10 may also be useful for laminating other types of webs and in other types of processes, and accordingly the scope of the invention should not be restricted to the specific types of webs or processes discussed herein.

Generally, the apparatus 10 includes a frame 32 adapted to be positioned in a predetermined orientation with respect to the second web 14, and web-laminating means 34 (e.g., two opposed rollers 33 and 35) mounted on the frame along the path of the second web for pressing the webs 12 and 14 together to adhere the first web 14 to the second web. The upper web-laminating roller 33 may be a driven roller pulling the first web between the web-laminating rollers 33 and 35, and the lower web-laminating roller 35 may be an idler roller "nipping" or pressing the first and second webs 12 and 14 between the web-laminating rollers.

Rotatable-holding means 36 (e.g., an axle assembly 36) is provided on the frame 32 for rotatably holding the first-web-supply roll 20 to supply the first web 12 to the web-laminating means 34 at a longitudinal speed substantially equal to the longitudinal speed of the second web 14. The rotatable-holding means 36 and first-web-supply roll 20 are movable laterally (rightwardly and leftwardly in FIGS. 2–5) relative to the first longitudinal direction, that is, they are free to translate along their common axis AX-3 of rotation. A brake 37 (FIG. 3) may be provided for stopping or resisting motion of the rotatable-holding means 36 to prevent premature unwinding or bunching up of the first web 12 on the first-web-supply roll 20 and to maintain tension in the first web 12. Transferring means 38 (e.g., wheel 72 and roller 74) is provided on the frame 32 for transferring the first web 12 from the first-web-supply roll 20 to the web-laminating means 34.

An alignment device 40 is mounted on the frame 32 for aligning the first web 12 with respect to a predetermined path of travel. The alignment device 40 comprises first-web-guiding means (also 40) that is generally rigid in the direction generally parallel to the axis AX-3 of rotation of the rotatable-holding means 36 (e.g., right and left in FIGS. 2–5). The first-web-guiding means 40 is adapted for guiding or positioning the opposite edges 16, 18 of the outer web layer 24 of the first-web-supply roll 20 laterally (e.g., leftwardly and rightwardly in FIGS. 2–5) with respect to the first-web-longitudinal direction, with the rotatable-holding means 36 affording translation of the first-web-supply roll 20 to accommodate telescoped or non-uniformly wound supply rolls (see, e.g., FIG. 2). Thus the outer web layer 24 is maintained in alignment with respect to the predetermined path of travel.

Figure 2:
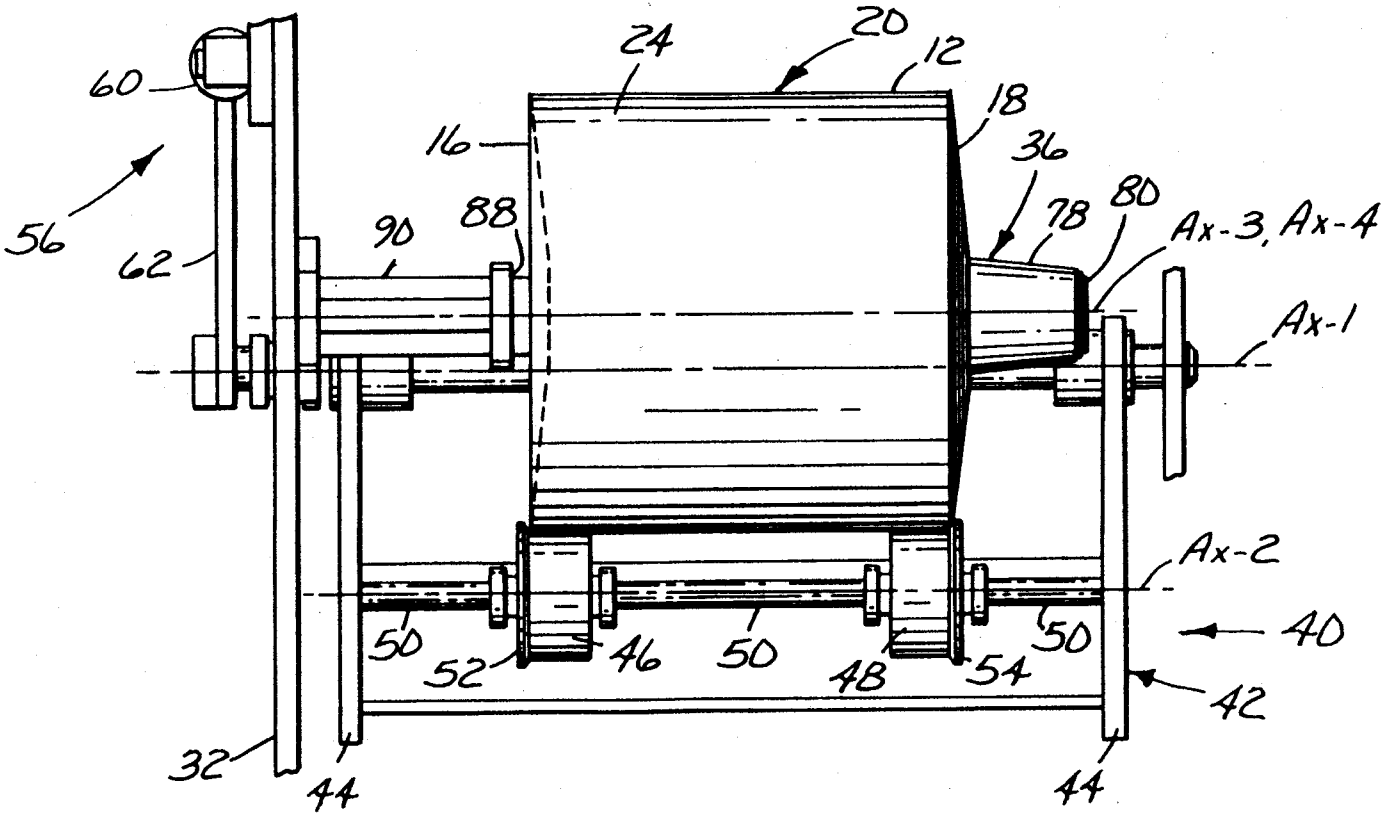
FIG. 2 is a top plan view of the apparatus of FIG. 1.

As shown in FIGS. 1 and 2, the first-web-guiding means 40 comprises a pivotable arm assembly 42 mounted on the frame 32 and pivotable on axis AX-1. The arm assembly 42 is generally rigid in the direction generally parallel to the pivot axis AX-1 of the arm assembly and to the rotational axis AX-3 of the axle assembly 36. The arm assembly 42 has a free end 44 opposite the pivot axis AX-1. Two guide rollers 46 and 48 are rotatably supported on the arm assembly 42 by an axle 50 (FIG. 2) adjacent the free end 44 of the arm assembly. The guide rollers 46 and 48 are adapted to roll against the opposite edges 16 and 18 of the outer web layer 24 to position the outer web layer laterally relative to the second web 14. The guide rollers 46 and 48 preferably rotate around a common axis AX-2, e.g., the axle 50, that is substantially parallel to the rotational axis AX-3 of the rotatable-holding means 36. Each guide roller 46, 48 includes a circumferential shoulder 52, 54 extending generally radially outwardly from the roller for guiding one of the opposite edges 16, 18 of the outer web layer 24.

Means 56 is preferably provided for biasing the free end 44 of the arm assembly 42 toward the rotatable-holding means 36. The biasing means 56 maintains the guide rollers 46 and 48 in rolling engagement with the outer web layer 24 of the first-web-supply roll 20 at a position designated 58 in FIG. 1 immediately before the web 12 separates from the roll as it is supplied to the web-laminating means 34. This arrangement is believed to reduce "bunching up" of the outer web layer 24 on the first-web-supply roll 20. The arm-assembly-biasing means 56 may comprise a manually actuatable air cylinder 60, one end of which is pivotably mounted on the frame 32, and a linkage 62 interconnecting the arm assembly 42 and the air cylinder such that, when the air cylinder is pressurized (FIGS. 1 and 2), the arm assembly 42 is biased toward the rotatable-holding means 36. To facilitate replacement of the first-web-supply roll 20, manually actuatable means may be provided for deactivating or depressurizing the air cylinder 60. Such depressurizing means may include a directional control valve (not shown) connected to the air cylinder 60 via an air line 64. Deactivating the arm-assembly-biasing means 56 allows the arm assembly 42 to pivot away from the rotatable-holding means 36 sufficiently to permit placing a new first-web-supply roll 20 on the rotatable-holding means.

Backing-stripping means 66 (FIG. 1) is provided for stripping the backing web 28 from the first web 12 before the first web is supplied to the web-laminating means 34, and a frame-mounted backing-web-storing or take-up roller 68 is provided for holding the backing web 28 after it is stripped from the first web 12. The backing-stripping means 66 includes a stripping bar 69 around which the backing web 28 is pulled to separate the backing web from the first web 12, and a frame-mounted idler roller 70 in rolling engagement with the backing web 28 and so positioned (e.g., substantially as shown in FIG. 1) that the backing web 28 is pulled from the first web 12 at a predetermined angle (e.g., approximately 90 degrees). Driving means is provided for driving the backing-web-storing roller 68 such that the backing web is pulled from the first web 12 around the stripping bar 69, along the idler roller 70, and wound around the backing-web-storing roller 68. The driving means may include a suitable driving motor (not shown) or a suitable linkage (e.g., a chain, driving belt, or the like) with the upper web-laminating roller 33 and/or the transferring means 38.

The transferring means 38 (FIG. 1) comprises a pair of rollers or wheels, such as a frame-mounted, back-up idler roller 72 and a driven first-web-pulling wheel 74 rotatably mounted on the frame 32. The back-up roller 72 and first-web-pulling wheel 74 define a "nip point", at which the first web 12 is pulled by the first-web-pulling wheel 74 from the first-web-supply roll 20. The first-web-pulling wheel 74 is adapted to tension the first web 12 between the first-web-pulling wheel and the web-laminating means 34, and the backing-stripping means 66 is adapted to strip the backing web 28 from the first web 12 between the back-up roller 74 and the web-laminating means 34. The first-web-pulling wheel 74 may be coupled with the upper web-laminating roller 33 by a suitable linkage (e.g., gearing) to maintain the first-web-pulling wheel 74 at an appropriate rotational velocity relative to the driven laminating roller 33 for tensioning the first web 12 between the first-web-pulling wheel and the laminating rollers 33 and 35.

Figure 3:
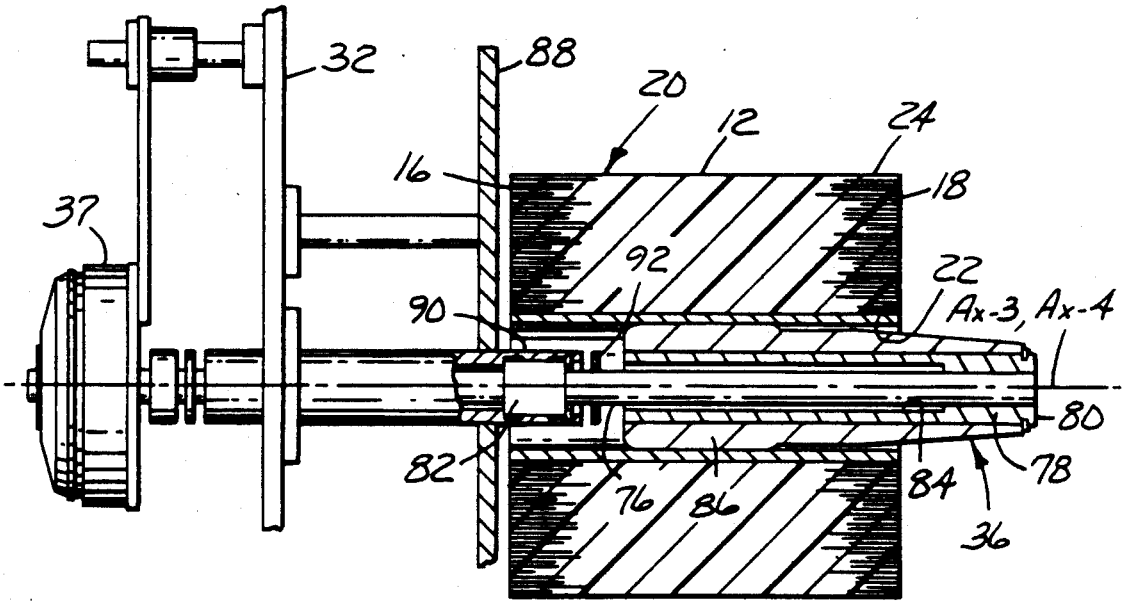
FIG. 3 is an enlarged cross-sectional view substantially along line 2—2 of FIG. 1, illustrating a mechanism for compensating for changes in the weight of or tension acting on a web supply roll used in the apparatus.
Figure 4:
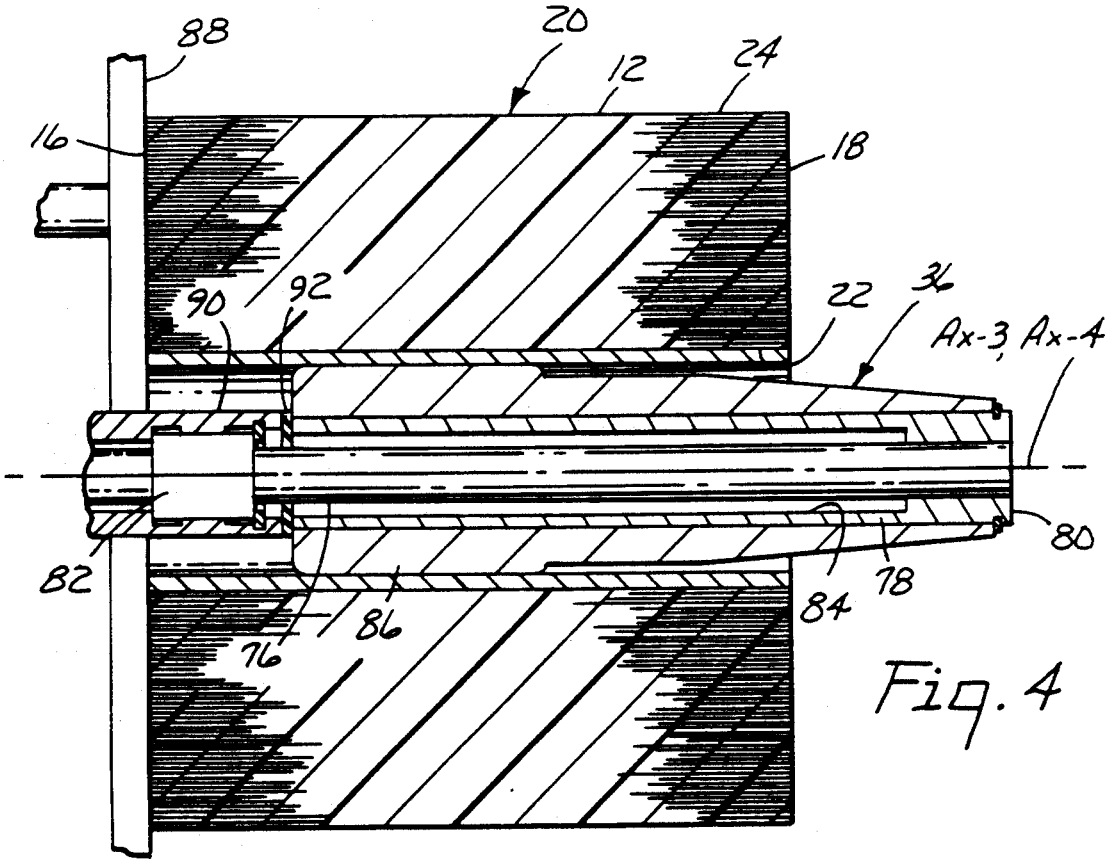
FIG. 4 is a further enlarged cross-sectional view similar to FIG. 3, showing the mechanism of FIG. 3 in its roll-loading position.
Figure 5:
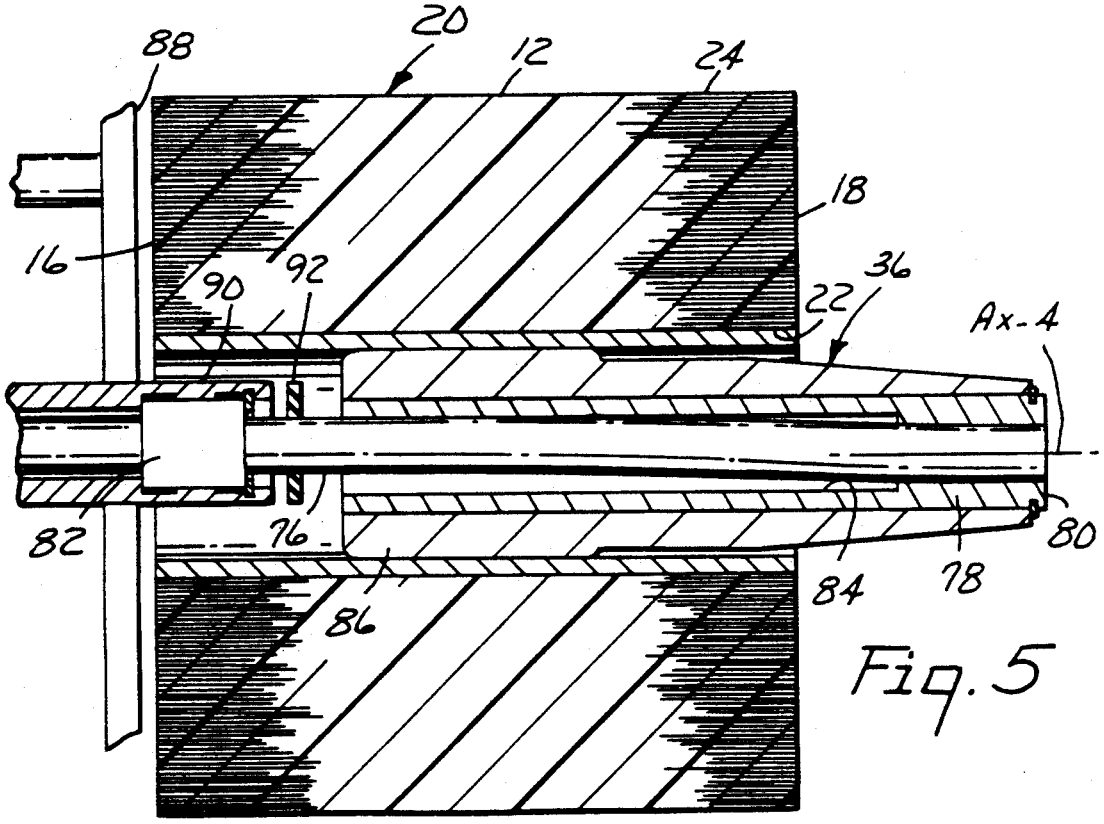
FIG. 5 is an enlarged cross-sectional view similar to FIGS. 3 and 4, showing the mechanism compensating for load or tension.

As shown in FIGS. 3–5, the rotatable-holding means 36 comprises a cantilever axle assembly (also 36) rotatably mounted on the frame 32 and having a central longitudinal axis AX-3 when unloaded. The cantilever axle assembly 36 comprises an inner elongate member 76 and an outer cylindrical member 78 having a rigidity substantially greater than the rigidity of the inner member. The inner member 76 is rotatably mounted on the frame 32, and extends generally coaxially outwardly (rightwardly in FIGS. 3–5) with respect to the axle assembly 36 substantially to the free or outer end 80 of the axle assembly (i.e., the end opposite the frame).

Bearing means is provided comprising low-friction bearings 82 rotatably supporting the inner member 76 on the frame 32 to permit the outer cylindrical member 78 to rotate relative to the the central axis AX-3 of the axle assembly. The inner and outer members 76 and 78 are substantially rigidly interconnected so that they rotate together on the bearings 82. The bearings 82 also permit axial movement (e.g., 2 in. (50 mm) movement) of the inner member 76 relative to the frame 32 so that the axle assembly 36 moves with the first-web-supply roll 20 when the roll is pushed generally laterally by the first-web-guiding means 40.

The outer cylindrical member 78 has a longitudinally-extending internal bore or cavity 84, and is mounted on the inner member 76 adjacent the free end 80 of the axle assembly 36. The outer member 78 extends substantially coaxially inwardly (leftwardly in FIGS. 3–5) with respect to the axle assembly 36 and inner member 76 substantially from the free end 80 toward the frame 32. Supply-roll-retaining means 86 are mounted along the outer member 78 adjacent the inner end (left end in FIGS. 3–5) of the outer member for holding the first-web-supply roll 20. For example, the supply-roll-retaining means 86 may comprise a chuck (also 86) having a plurality of spring-biased members (not shown) for releasably retaining the first-web-supply roll 20. Such a chuck is sold under the trade designation "Tilt-Lock" by the Central Machine Works Co. of Minneapolis, Minn.

The inner and outer members 76 and 78 are adapted for maintaining the outer member in a generally horizontal orientation wherein the central longitudinal axis AX-4 of the outer member 78 is maintained in a generally parallel orientation with respect to the its unloaded orientation regardless of the actual load on the outer member (see FIG. 5) so long as the actual load does not exceed the load for which the axle assembly 36 is designed. (As used herein, the "load" on the outer member 78 refers to the load due to tensioning of the first web 12 relative to the first-web-supply roll 20 and the weight of the first-web-supply roll.) As a result, the axis AX-4 of the outer member 78 is also maintained in a generally parallel orientation with respect to the axes of rotation of the back-up roller 72 and first-web-pulling wheel 74. This arrangement facilitates even longitudinal tensioning of the first web 12 laterally along the web between the first-web-supply roll 20 and the back-up roller 72. (That is, the tension of the first web 12 in the first-web-longitudinal direction is preferably maintained generally even or constant laterally along the web.) Maintaining such even tensioning of the first web 12 separating from the first-web-supply roll 20 is believed to improve tracking of the first web 12 and reduce lateral wandering of the web 12, and thereby to assist the alignment device 40 in maintaining the first web 12 in alignment with respect to its predetermined path of travel so that the first web 12 is laminated to the second web 14 with the edges of the webs maintained in a desired predetermined relationship (e.g., aligned).

Abutment means 88 may be provided on the frame 32 for abutting the first-web-supply roll 20 during loading of the roll onto the axle assembly 36 to properly position the roll on the assembly. The abutment means 88 comprises an aluminum or steel abutment plate (also 88) mounted on the frame 32 and extending radially outwardly (upwardly and downwardly in FIGS. 3–5) substantially from the axis AX-3 of the axle assembly 36 beyond the outer web layer 24 of an unused first-web-supply roll 20.

The abutment means 88 cooperates with the bearings 82 to facilitate proper positioning of the first-web-supply roll 20. The bearings 82 permit axial movement of the axle assembly 36 between a roll-loading position (FIG. 4) and a range of operating positions (e.g., FIGS. 3 and 5 show the axle assembly 36 in one of the operating positions). When the axle assembly 36 is in its roll-loading position (FIG. 4), the supply-roll-retaining means 86 is spaced from the abutment plate 88 by a bearing housing 90 such that the first-web-supply roll 20 is centered over the supply-roll-retaining means 86 when the roll 20 abuts the plate 88. Thus the first-web-supply roll 20 may be properly centered over the supply-roll-retaining means 86 merely by pushing the roll onto the supply-roll-retaining means as far as the roll will go, that is, until it abuts plate 88. The range of operating positions of the axle assembly 36 is defined as those positions wherein the supply-roll-retaining means 86 is spaced sufficiently from the abutment plate 88 to hold a first-web-supply roll 20 centered on the supply-roll-retaining means (as discussed above) spaced sufficiently from the abutment plate to prevent rubbing of the roll 20 against the plate 88 during operation of the apparatus 10.

An annular rubber bumper 92 may be provided on the inner elongate member 76 between the bearing housing 90, on one side, and the outer member 78 and chuck 86, on the other side. The bumper 92 reduces the noise that would otherwise be caused the outer member 78 and chuck 86 hitting the bearing housing 90 when the axle assembly 36 is pushed to its roll-loading position.

In operation, the first web 12 is pulled from the first-web-supply roll 20 at 58 by the first-web-pulling wheel 74. The first web 12 travels around the first-web-pulling wheel 74 after reversing direction around the back-up roller 72. The first web 12 is then pulled from the first-web-pulling wheel 74 by the upper web-laminating wheel 33, and is pressed between the web-laminating wheels 33 and 35 with the second web 14 to laminate the webs. Between the first-web-pulling wheel 74 and web-laminating wheels 35, the backing web 28 is stripped from the adhesive side 26 of the first web by the stripping bar 69, and pulled along the idler roller 70 onto the take-up roller 68. The guide rollers 46 and 48 roll against the outer web layer 24 to maintain the outer web layer 24 and the first web 12 in proper orientation relative to the desired path of travel of the first web 12, the axle assembly 36 translating axially to compensate for any telescoping or non-uniform winding of the first-web-supply roll 20. Thus the first web 12 is supplied to the back-up roller 74 and first-web-pulling wheel 72, and then to the web-laminating wheels 35, with the edges 16, 18 of the first web 12 in alignment with the edges of the second web 14.

As various changes could be made in the above constructions without departing from the scope of the invention, it is intended that all matter contained in the description above or shown in the accompanying drawing shall be interpreted as illustrative and not in a limiting sense.

I claim:

1. Apparatus for aligning an elongate web with respect to a predetermined path of travel, the web having opposite edges extending longitudinally of the web and being supplied from a supply roll formed by the web being wound around an inner web layer and having an outer web layer, the apparatus comprising:

a frame;

rotatable-holding means on the frame adapted to hold the supply roll for rotation about an axis to afford unwinding of the web from the supply roll, and adapted for axial movement of the supply roll; and an alignment device comprising web-guiding means mounted on the frame generally rigid in the direction parallel to the axis of the rotatable-holding means for guiding the opposite edges of the outer web layer of the supply roll laterally with respect to the longitudinal direction of the web, with the rotatable-holding means affording translation of the supply roll to accommodate telescoped or non-uniformly wound supply rolls, thereby to maintain alignment of the outer web layer with respect to the predetermined path of travel;

the web-guiding means comprising a web guide including at least one guide roller adapted to roll along the opposite edges of the outer web layer to position the outer web layer laterally with respect to the longitudinal direction of the web without engaging web layers that are spaced substantially inwardly of the outer web layer, and means for maintaining the web guide in engagement with the outer web layer of the supply roll.

2. Apparatus according to claim 1 wherein the web guide includes two guide rollers adapted to roll against the opposite edges of the outer web layer to position the outer web layer laterally relative to the predetermined path of travel without the guide rollers engaging web layers that are spaced substantially inwardly of the outer web layer.

3. Apparatus according to claim 2 wherein the guide rollers rotate around a common axis generally parallel with respect to the axis of the rotatable-holding means, each guide roller including a circumferential shoulder extending generally radially outwardly from the roller for guiding one of the opposite edges of the outer web layer, the circumferential shoulders being sized for guiding the opposite edges of the outer web layer without engaging web layers that are spaced substantially inwardly of the outer web layer.

4. Apparatus for aligning an elongate web with respect to a predetermined path of travel, the web having opposite edges extending longitudinally of the web and being supplied from a supply roll formed by the web being wound around an inner web layer and having an outer web layer, the apparatus comprising:

a frame;

rotatable-holding means on the frame adapted to hold the supply roll for rotation about an axis to afford unwinding of the web from the supply roll, and adapted for axial movement of the supply roll; and an alignment device comprising web-guiding means mounted on the frame generally rigid in the direction parallel to the axis of the rotatable-holding means for guiding the opposite edges of the outer web layer of the supply roll laterally with respect to the longitudinal direction of the web, with the rotatable-holding means affording translation of the supply roll to accommodate telescoped or non-uniformly wound supply rolls, thereby to maintain alignment of the outer web layer with respect to the predetermined path of travel;

the web-guiding means including two guide rollers adapted to roll against the opposite edges of the outer web layer to position the outer web layer laterally relative to the predetermined path of travel, with the guide rollers rotating around a common axis generally parallel with respect to the axis of the rotatable-holding means, each guide roller including a circumferential shoulder extending generally radially outwardly from the roller for guiding one of the opposite edges of the outer web layer;

the web-guiding means further comprising an arm assembly pivotable on an axis generally parallel to the axis of the rotatable-holding means, the arm assembly having a free end, an axle adjacent the free end of the arm assembly for rotatably supporting the guide rollers, and fluid pressure actuatable means for biasing the free end of the arm assembly toward the rotatable-holding means to maintain the guide rollers in rolling engagement with the outer web layer of the supply roll, the rotatable-holding means including a cantilever axle assembly on the frame for holding and affording rotation of the supply roll, the arm-assembly-biasing means including manually actuatable means for deactivating the arm-assembly-biasing means to allow the arm assembly to be pivoted away from the axle assembly, thereby facilitating replacement of the supply roll.

5. Apparatus according to claim 4 wherein the guide rollers are biased against the outer web layer of the supply roll at a position immediately before the web separates from the roll.

6. Apparatus for aligning an elongate web with respect to a predetermined path of travel, the web having opposite edges extending longitudinally of the web and being supplied from a supply roll formed by the web being wound around an inner web layer and having an outer web layer, the apparatus comprising:

a frame;

rotatable-holding means on the frame adapted to hold the supply roll for rotation about an axis to afford unwinding of the web from the supply roll, and adapted for axial movement of the supply roll; and an alignment device comprising web-guiding means mounted on the frame generally rigid in the direction parallel to the axis of the rotatable-holding means for guiding the opposite edges of the outer web layer of the supply roll laterally with respect to the longitudinal direction of the web, with the rotatable-holding means affording translation of the supply roll to accommodate telescoped or non-uniformly wound supply rolls, thereby to maintain alignment of the outer web layer with respect to the predetermined path of travel;

the web-guiding means including two guide rollers adapted to roll against the opposite edges of the outer web layer to position the outer web layer laterally relative to the predetermined path of travel, with the guide rollers rotating around a common axis generally parallel with respect to the axis of the rotatable-holding means, each guide roller including a circumferential shoulder extending generally radially outwardly from the roller for guiding one of the opposite edges of the outer web layer;

the web-guiding means further comprising an arm assembly pivotable on an axis generally parallel to the axis of the rotatable-holding means, the arm assembly having a free end, an axle adjacent the free end of the arm assembly for rotatably supporting the guide rollers, and means for biasing the free end of the arm assembly toward the rotatable-holding means to maintain the guide rollers in rolling engagement with the outer web layer of the supply roll, the guide rollers biased against the outer web layer of the supply roll at a position immediately before the web separates from the roll, the rotatable-holding means including a cantilever axle assembly on the frame for holding and affording rotation of the supply roll, the arm-assembly-biasing means comprising a manually actuatable air cylinder and a linkage interconnecting the arm assembly and the air cylinder such that, when the air cylinder is pressurized, the arm assembly is biased toward the rotatable-holding means, the manually actuatable means for deactivating the arm-assembly-biasing means including a valve for depressurizing the air cylinder to allow the arm assembly to be pivoted away from the axle assembly, thereby facilitating replacement of the supply roll.

7. Apparatus for aligning an elongate web with respect to a predetermined path of travel, the web having opposite edges extending longitudinally of the web and being supplied from a supply roll formed by the web being wound around an inner web layer and having an outer web layer, the apparatus comprising:

a frame;

rotatable-holding means on the frame adapted to hold the supply roll for rotation about an axis to afford unwinding of the web from the supply roll, and adapted for axial movement of the supply roll, the rotatable-holding means for holding the supply roll comprising a cantilever axle assembly mounted on the frame and having a generally horizontal central longitudinal axis and a free end opposite the frame, the cantilever axle assembly comprising:

an inner elongate member mounted on the frame and extending substantially to the free end of the axle assembly generally coaxially with respect to the axle assembly;

an outer cylindrical member having a longitudinally-extending internal bore or cavity mounted on the inner member adjacent the free end of the axle assembly and extending substantially coaxially with respect to the axle assembly and inner member substantially from the free end toward the frame, the outer cylindrical member having supply-roll-retaining means for holding the supply roll; and bearing means permitting the outer cylindrical member to rotate relative to the central axis of the axle assembly;

the inner and outer members being adapted for maintaining the axis of the outer member, when loaded, in an orientation generally parallel to the position of the axis of the outer member when unloaded, thereby facilitating even tensioning of the web separating form the supply roll to reduce lateral wandering of the web; and an alignment device comprising web-guiding means mounted on the frame generally rigid in the direction parallel to the axis of the rotatable-holding means for guiding the opposite edges of the outer web layer of the supply roll laterally with respect to the longitudinal direction of the web, with the rotatable-holding means affording translation of the supply roll to accommodate telescoped or non-uniformly wound supply rolls, thereby to maintain alignment of the outer web layer with respect to the predetermined path of travel.

8. Apparatus according to claim 7 wherein the bearing means comprises generally low friction bearings rotatably supporting the inner member on the frame, the inner and outer members being substantially rigidly interconnected so that they rotate together.

9. Apparatus according to claim 8 wherein the bearing means further comprises bearings permitting axial movement of the inner member relative to the frame so that the axle assembly moves with the supply roll when the roll is pushed generally laterally by the web-guiding means.

10. Apparatus according to claim 9 wherein the frame includes abutment means for abutting the supply roll during loading of the roll onto the axle assembly to position the roll on the assembly, the axle assembly being axially movable between a loading position, wherein the supply-roll-retaining means is spaced from the abutment means such that the supply roll is substantially centered over the supply-roll-retaining means when the roll abuts the abutment means, and a range of operating positions, wherein the supply-roll-retaining means is spaced sufficiently from the abutment means to hold a supply roll centered on the supply-roll-retaining means spaced from the abutment means.

11. Apparatus according to claim 10 wherein the outer cylindrical member extends from an outer end adjacent the free end of the axle assembly toward the frame to an inner end, the supply-roll-retaining means being positioned along the outer member adjacent the inner end of the outer member, the supply-roll-retaining means comprising a chuck having a plurality of spring-biased members for releasably retaining the first-web-supply roll.

12. Apparatus for laminating a first elongate web having a first-web-longitudinal direction to a second elongate web moving along a predetermined, generally constant path in a second-web-longitudinal direction, the first web having opposite edges extending longitudinally of the web and being supplied from a first-web-supply roll formed by the web being wound around an inner web layer and having an outer web layer, the apparatus comprising:

a frame adapted to be positioned in a predetermined orientation with respect to the second web;

web-laminating means on the frame along the path of the second web for pressing the webs together to adhere the first web to the second web;

rotatable-holding means on the frame adapted to hold the first-web-supply roll for rotation about an axis to afford unwinding of the first web from first-web-supply roll, and adapted for axial movement of the first-web-supply roll; transferring means on the frame for transferring the first web to the web-laminating means; and an alignment device comprising first-web-guiding means on the frame substantially rigid in a direction generally parallel to the axis of rotation of the rotatable-holding means for guiding the opposite edges of the outer web layer of the first-web-supply roll laterally with respect to the first-web-longitudinal direction, with the rotatable-holding means affording translation of the first-web-supply roll to accommodate telescoped or non-uniformly wound first-web-supply rolls, thereby to maintain the first web unwinding from the first-web-supply roll in such orientation that the first web is transferred via the transferring means to the web-laminating means with the edges of the first web in a predetermined relationship with respect to the second web;

the first-web-guiding means comprising a web guide including at least one roller adapted to roll along the opposite edges of the outer web layer to position the outer web layer laterally relative to the second web without engaging web layers of the first-web-supply roll spaced substantially inwardly of the outer web layer, and means for maintaining the web guide in engagement with the outer web layer of the first-web-supply roll.

13. Apparatus according to claim 12 wherein the web guide includes two guide rollers adapted to roll against the opposite edges of the outer web layer to position the outer web layer laterally relative to the second web without engaging web layers of the first-web-supply roll spaced substantially inwardly of the outer web layer.

14. Apparatus according to claim 13 wherein the guide rollers rotate around a common axis generally parallel to the axis of the rotatable-holding means, each guide roller including a circumferential shoulder extending generally radially outwardly from the roller for guiding one of the opposite edges of the outer web layer, the circumferential shoulders being sized for guiding the opposite edges of the outer web layer without engaging web layers of the first-web-supply roll that are spaced substantially inwardly of the outer web layer.

15. Apparatus for laminating a first elongate web having a first-web-longitudinal direction to a second elongate web moving along a predetermined, generally constant path in a second-web-longitudinal direction, the first web having opposite edges extending longitudinally of the web and being supplied from a first-web-supply roll formed by the web being wound around an inner web layer and having an outer web layer, the apparatus comprising:

a frame adapted to be positioned in a predetermined orientation with respect to the second web;

web-laminating means on the frame along the path of the second web for pressing the webs together to adhere the first web to the second web;

rotatable-holding means on the frame adapted to hold the first-web-supply roll for rotation about an axis to afford unwinding of the first web from first-web-supply roll, and adapted for axial movement of the first-web-supply roll;

transferring means on the frame for transferring the first web to the web-laminating means; and an alignment device comprising first-web-guiding means on the frame substantially rigid in a direction generally parallel to the axis of rotation of the rotatable-holding means for guiding the opposite edges of the outer web layer of the first-web-supply roll laterally with respect to the first-web-longitudinal direction, with the rotatable-holding means affording translation of the first-web-supply roll to accommodate telescoped or non-uniformly wound first-web-supply rolls, thereby to maintain the first web unwinding from the first-web-supply roll in such orientation that the first web is transferred via the transferring means to the web-laminating means with the edges of the first web in a predetermined relationship with respect to the second web;

the first-web-guiding means including two guide rollers adapted to roll against the opposite edges of the outer web layer to position the outer web layer laterally relative to the second web, with the guide rollers rotating around a common axis generally parallel to the axis of the rotatable-holding means, each guide roller including a circumferential shoulder extending generally radially outwardly from the roller for guiding one of the opposite edges of the outer web layer;

the first-web-guiding means further comprising an arm assembly pivotable on an axis generally parallel to the axis of the rotatable-holding means, the arm assembly having a free end, an axle adjacent the free end of the arm assembly for rotatably supporting the guide rollers, and means for biasing the free end of the arm assembly toward the rotatable-holding means to maintain the guide rollers in rolling engagement with the outer web layer of the first-web-supply roll, the arm-assembly-biasing means including manually fluid pressure actuatable means for deactivating the arm-assembly-biasing means to allow the arm assembly to be pivoted away from the rotatable-holding means, thereby facilitating replacement of the first-web-supply roll.

16. Apparatus according to claim 15 wherein the guide rollers are biased against the outer web layer of the first-web-supply roll at a position immediately before the web separates from the roll as it is supplied to the web-laminating means.

17. Apparatus for laminating a first elongate web having a first-web-longitudinal direction to a second elongate web moving along a predetermined, generally constant path in a second-web-longitudinal direction, the first web having opposite edges extending longitudinally of the web and being supplied from a first-web-supply roll formed by the web being wound around an inner web layer and having an outer web layer, the apparatus comprising:

a frame adapted to be positioned in a predetermined orientation with respect to the second web;

web-laminating means on the frame along the path of the second web for pressing the webs together to adhere the first web to the second web;

rotatable-holding means on the frame adapted to hold the first-web-supply roll for rotation about an axis to afford unwinding of the first web from first-web-supply roll, and adapted for axial movement of the first-web-supply roll;

transferring means on the frame for transferring the first web to the web-laminating means; and an alignment device comprising first-web-guiding means on the frame substantially rigid in a direction generally parallel to the axis of rotation of the rotatable-holding means for guiding the opposite edges of the outer web layer of the first-web-supply roll laterally with respect to the first-web-longitudinal direction, with the rotatable-holding means affording translation of the first-web-supply roll to accommodate telescoped or non-uniformly wound first-web-supply rolls, thereby to maintain the first web unwinding from the first-web-supply roll in such orientation that the first web is transferred via the transferring means to the web-laminating means with the edges of the first web in a predetermined relationship with respect to the second web;

the first-web-guiding means including two guide rollers adapted to roll against the opposite edges of the outer web layer to position the outer web layer laterally relative to the second web, with the guide rollers rotating around a common axis generally parallel to the axis of the rotatable-holding means, each guide roller including a circumferential shoulder extending generally radially outwardly from the roller for guiding one of the opposite edges of the outer web layer;

the first-web-guiding means further comprising an arm assembly pivotable on an axis generally parallel to the axis of the rotatable-holding means, the arm assembly having a free end, an axle adjacent the free end of the arm assembly for rotatably supporting the guide rollers, and means for biasing the free end of the arm assembly toward the rotatable-holding means at a position immediately before the web separates from the roll as it is supplied to the web-laminating means to maintain the guide rollers in rolling engagement with the outer web layer of the first-web-supply roll, the arm-assembly-biasing means comprising a manually actuatable air cylinder and a linkage interconnecting the arm assembly and the air cylinder such that, when the air cylinder is pressurized, the arm assembly is biased toward the rotatable-holding means, the manually actuatable means for deactivating the arm-assembly-biasing means including a valve for depressurizing the air cylinder, allowing the arm assembly to be pivoted away from the rotatable-holding means, thereby facilitating replacement of the first-web-supply roll.

18. Apparatus according to claim 17 wherein the first web is of the type having a layer of pressure sensitive adhesive and a backing web covering the adhesive and being adapted to be stripped away from the first web to expose the adhesive layer, the apparatus further comprising backing-stripping means mounted on the frame for stripping the backing web from the first web before the first web is supplied to the web-laminating means, and a backing-web-storing roller for holding the backing web after it is stripped from the first web, the backing-stripping means comprising a stripping bar around which the backing web is separated from the first web, an idler roller in rolling engagement with the backing web so positioned that the backing web is pulled from the first web at a predetermined angle, and driving means for driving the backing-web-storing roller such that the backing web is pulled around the stripping bar, along the idler roller, and wound around the backing-web-storing roller.

19. Apparatus according to claim 18 wherein the transferring means comprises a first-web-pulling wheel for pulling the first web from the first-web-supply roll, and a back-up roller around which the first web runs before being pulled around the first-web-pulling wheel, the first-web-pulling wheel being adapted to tension the first web between the first-web-pulling wheel and the web-laminating means, and the backing-stripping means being adapted to strip the backing web from the first web between the first-web-pulling wheel and the web-laminating means.

20. Apparatus according to claim 1 wherein the web guide is biased against the outer web layer of the supply roll at a position immediately before the web separates from the roll.

21. Apparatus according to claim 1 wherein the means for maintaining the web guide in engagement with the outer web layer of the supply roll comprises an arm assembly pivotable on an axis generally parallel to the axis of the rotatable-holding means, the arm assembly supporting the web guide, the arm-assembly-biasing means including fluid pressure actuatable means for biasing the arm assembly toward the rotatable-holding means to maintain the web guide in engagement with the outer web layer of the supply roll.

22. Apparatus according to claim 21 wherein the rotatable-holding means includes a cantilever axle assembly on the frame for holding and affording rotation of the supply roll, the arm-assembly-biasing means including manually actuatable means for depressurizing the fluid pressure actuatable means to deactivate the arm-assembly-biasing means to allow the arm assembly to be pivoted away from the axle assembly to facilitate replacement of the supply roll.

23. Apparatus according to claim 4 wherein the circumferential shoulders of the guide rollers are sized for guiding the opposite edges of the outer web layer without engaging web layers that are spaced substantially inwardly of the outer web layer.

24. Apparatus according to claim 7 wherein the web-guiding means is configured for guiding the opposite edges of the outer web layer without engaging web layers that are spaced substantially inwardly of the outer web layer.

25. Apparatus according to claim 12 wherein the web guide is biased against the outer web layer of the supply roll at a position immediately before the web separates from the roll.

26. Apparatus according to claim 15 wherein the circumferential shoulders of the guide rollers are sized for guiding the opposite edges of the outer web layer without engaging web layers that are spaced substantially inwardly of the outer web layer.

27. Apparatus for aligning an elongate web with respect to a predetermined path of travel, the web having opposite edges extending longitudinally of the web and being supplied from a supply roll formed by the web being wound around an inner web layer and having an outer web layer, the apparatus comprising:

a frame;

rotatable-holding means on the frame adapted to hold the supply roll for rotation about an axis to afford unwinding of the web from the supply roll, and adapted for axial movement of the supply roll, the rotatable-holding means for holding the supply roll comprising a cantilever axle assembly mounted on the frame and having a central longitudinal axis and a free end opposite the frame, the cantilever axle assembly comprising:

an inner elongate member mounted on the frame and extending substantially to the free end of the axle assembly generally coaxially with respect to the axle assembly;

an outer member having a longitudinally extending internal bore or cavity mounted on the inner member adjacent the free end of the axle assembly and extending substantially coaxially with respect to the axle assembly and inner member substantially from the free end toward the frame, the outer cylindrical member having supply-roll-retaining means for holding the supply roll; and bearing means permitting the supply-roll-retaining means to rotate relative to the central axis of the axle assembly;

the inner and outer members being adapted for maintaining the axis of the outer member, when loaded, in an orientation generally parallel to the position of the axis of the outer member when unloaded, thereby facilitating even tensioning of the web separating from the supply roll to reduce lateral wandering of the web; and an alignment device comprising web-guiding means mounted on the frame generally rigid in the direction parallel to the axis of the rotatable-holding means for guiding the opposite edges of the outer web layer of the supply roll laterally with respect to the longitudinal direction of the web, with the rotatable-holding means affording translation of the supply roll to accommodate telescoped or non-uniformly wound supply rolls, thereby to maintain alignment of the outer web layer with respect to the predetermined path of travel.

28. Apparatus according to claim 27 wherein the web-guiding means is configured for guiding the opposite edges of the outer web layer without engaging web layers that are spaced substantially inwardly of the outer web layer.

29. Apparatus according to claim 28 wherein the bearing means comprises generally low friction bearings rotatably supporting the inner member on the frame, the inner and outer members being substantially rigidly interconnected so that they rotate together, the bearings permitting axial movement of the inner member relative to the frame so that the axle assembly moves with the supply roll when the roll is pushed generally laterally by the web-guiding means.

30. Apparatus according to claim 29 wherein the frame includes abutment means for abutting the supply roll during loading of the roll onto the axle assembly to position the roll on the assembly, the axle assembly being axially movable between a loading position, wherein the supply-roll-retaining means is spaced from the abutment means such that the supply roll is substantially centered over the supply-roll-retaining means when the roll abuts the abutment means, and a range of operating positions, wherein the supply-roll-retaining means is spaced sufficiently from the abutment means to hold a supply roll centered on the supply-roll-retaining means spaced from the abutment means.

* * * * *

UNITED STATES PATENT AND TRADEMARK OFFICE

CERTIFICATE OF CORRECTION

PATENT NO. : 4,990,215

DATED : February 5, 1991

INVENTOR(S) : Conrad V. Anderson

It is certified that error appears in the above-identified patent and that said Letters Patent is hereby corrected as shown below:

Col. 10, line 24, "form" should read --from--.

Signed and Sealed this

Fourth Day of May, 1993

*Attest:*

Michael K. Kirk

MICHAEL K. KIRK

*Attesting Officer*

*Acting Commissioner of Patents and Trademarks*